252-95 AU 160/75 EX
3/23/82 XR 4,321,157

United States Patent [19]

Harris et al.

[11] 4,321,157

[45] Mar. 23, 1982

[54] GRANULAR LAUNDRY COMPOSITIONS

[75] Inventors: Richard G. Harris, Morpeth; Ian Gray, Gosforth, both of England

[73] Assignee: The Procter & Gamble Company, Cincinnati, Ohio

[21] Appl. No.: 202,528

[22] Filed: Oct. 31, 1980

[30] Foreign Application Priority Data

Nov. 3, 1979 [GB] United Kingdom ..... 38144/79

[51] Int. Cl.[3] ..... C11D 9/18; C11D 7/36

[52] U.S. Cl. ..... 252/174.25; 252/95; 252/174.16; 252/174.21; 252/174.22

[58] Field of Search ..... 252/95, 174.25, 174.26, 252/174.22, 174.16

[56] References Cited

U.S. PATENT DOCUMENTS

| | | | |
|---|---|---|---|
| 3,441,507 | 4/1969 | Schiefer et al. . | |
| 3,494,786 | 2/1970 | Nielsen . | |
| 3,494,787 | 2/1970 | Lund et al. . | |
| 3,639,248 | 2/1972 | Moyer et al. . | |
| 4,009,113 | 2/1977 | Green et al. . | |
| 4,062,647 | 12/1977 | Storm et al. . | |
| 4,064,062 | 12/1977 | Yurko . | |
| 4,087,369 | 5/1978 | Wevers . | |
| 4,179,390 | 12/1979 | Spadini et al. . | |
| 4,220,562 | 9/1980 | Spadini et al. . | |
| 4,248,928 | 2/1981 | Spadini | 252/91 X |
| 4,290,903 | 9/1981 | Macgilp et al. | 252/91 |

FOREIGN PATENT DOCUMENTS

| | | |
|---|---|---|
| 2741680 | 3/1978 | Fed. Rep. of Germany . |
| 836988 | 6/1960 | United Kingdom . |
| 1504211 | 3/1978 | United Kingdom . |

*Primary Examiner*—Mayer Weinblatt

[57] ABSTRACT

Granular laundry compositions comprising a particulate mixture of a water-insoluble natural or synthetic silica or silicate, a finely-divided organic peroxy acid bleach precursor, and an alkoxylated nonionic surfactant. The particulate mixture has a pH in 2% aqueous dispersion of from about pH 2 to about pH 9. The compositions have improved granular physical characteristics, chemical stability and rate of solution/dispersion characteristics. They are useful in bleach activator, bleaching, detergent and laundry additive compositions.

11 Claims, No Drawings

GRANULAR LAUNDRY COMPOSITIONS

TECHNICAL FIELD

The present invention relates to granular laundry compositions. In particular it pertains to compositions containing activators for oxygen-releasing compounds, especially activators in the form of organic peroxyacid bleach precursors. The laundry compositions are useful as bleach activator compositions, bleaching compositions, detergent compositions, laundry additive compositions and the like. As used herein, the terms bleach activator and organic peroxyacid bleach precursor are used synonomously.

BACKGROUND ART

It is well known that peroxygen bleaching agents, e.g., perborates, percarbonates, perphosphates, persilicates etc., are highly useful for chemical bleaching of stains found on both colored and white fabrics. Such bleaching agents are most effective at high wash solution temperatures, i.e., above about 70° C. In recent years, attempts have been made to provide bleaching compositions that are effective at lower wash solution temperatures, i.e., between room temperature and 70° C. In consequence, bleaching agents have been investigated which exhibit their optimum bleach activity in this temperature range. These low temperature bleaches are useful in a variety of products intended for use under machine or hand-wash conditions, e.g., additive, pre-additive or soak-type laundry compositions as well as all-purpose detergent compositions.

A very effective class of low temperature bleach system comprises a peroxy bleach compound and an organic peroxyacid bleach precursor which react together to form the organic peroxyacid bleach in the wash solution. Examples of detergent compositions incorporating bleaching agents of this type are disclosed in U.S. Pat. No. 2,362,401 (Reicher et al), U.S. Pat. No. 3,639,248 (Moyer) and in British Pat. No. 836,988 and 855,735.

It is well-known, however, that bleach-activator containing detergent compositions suffer a number of technical problems which until now have limited their commercial applicability and market success. The underlying problem is that of activator instability, i.e., the tendency of the activator to degrade by hydrolysis and perhydrolysis reactions under the alkaline and oxidizing conditions typically encountered in detergent compositions during storage. This leads not only to loss of bleaching efficacy but also to degradation of other sensitive ingredients in the detergent formula, for example perfumes, optical brighteners, enzymes, dyes etc.

In the art, two major approaches have been used to tackle the instability problem. In the first approach, the activator is protected from its hostile alkaline/oxidizing environment by agglomeration, coating or encapsulation with a non-hygroscopic, preferably hydrophobic agglomerating, coating or encapsulating material (see for instance U.S. Pat. Nos. 3,494,786 (Neilson), 3,494,787 (Lund and Neilson) and 3,441,507 (Scheifer)). This technique suffers the disadvantage, however, that to be efficaceous, the agglomerating or coating material must be so water-impervious as to considerably inhibit the rate of release of bleach activator into the detergent wash liquor. This leads to diminished bleach effectiveness and increased cost. Where, on the other hand, a hydrophilic agglomerating or coating agent is used, for instance, a water-soluble nonionic surfactant, the hygroscopicity of the product is such that no meaningful improvement in activator stability can be achieved. This is particularly true where high levels of nonionic surfactant are included in the granule, for instance, levels in excess of about 15% by weight.

In the second approach to improving activator stability, the activator is incorporated in the detergent composition in the form of relatively coarse-sized particles (see, for instance, U.S. Pat. No. 4,087,369), the object being to reduce interaction of the activator with its environment by minimizing the surface/unit weight of the activator. This approach suffers the disadvantage, however, that the rate of dispersion and solubilization of the activator is so slow as to considerably increase the risk of fabric damage known as "pinpoint spotting". In essence, "pinpoint spotting" is a local bleach effect caused by slow dissolution of individual particles of the bleach system resulting in a locally high concentration of the bleaching agent at the fabric surface. High solubilization rate is thus seen to be critical for avoiding problems of damage to fabrics, but in as much as high solubilization rate has traditionally implied either a high activator surface/unit weight or agglomeration with a hygroscopic agglomerating agent, it follows that the twin aims of improving fabric safety and activator stability have been to a large degree mutually exclusive.

The present invention seeks, as one of its objectives, to resolve these conflicing requirements by providing a matrix of materials in particulate form that has excellent granular physical characteristics, activator stability and rate of solution/dispersion characteristics; that delivers these benefits in a composition comprising high levels of detergent functional nonionic surfactants; and which also delivers these benefits in a detergent composition prepared from highly alkaline and oxidizing detergent components.

SUMMARY OF THE INVENTION

Accordingly, the present invention provides a granular laundry composition comprising from about 0.5% to 100%, preferably from about 5% to 100%, by weight of a particulate mixture having a pH in 2% aqueous dispersion of from 2.0 to 9.0 and comprising:

(a) a finely-divided, water-insoluble natural or synthetic silica or silicate, (b) a finely-divided organic peroxy acid bleach precursor, and (c) an alkoxylated nonionic surfactant.

The natural or synthetic silica or silicate has an average primary particle size of less than about 10μ and a moisture content of from about 0.1% to about 30% by weight thereof, and is in admixture with the bleach precursor having an average particle size preferably less than about 500μ in a weight ratio of from about 20:1 to 1:10. The weight ratio of silica or silicate to nonionic surfactant falls in the range from about 20:1 to 1:3. The particulate mixture preferably has an average particle size of from about 250μ to about 3000μ, more preferably from about 500μ to about 2000μ.

The bleach activator is thus incorporated in a matrix of water-insoluble silica or silicate and alkoxylated nonionic surfactant, both of which classes of materials can be hydrophilic in nature, but which in the particulate mixture interact to provide an intrinsically hydrophobic, nonhygroscopic complex. The hydrophobicity of the particulate mixture can be determined by measuring the weight % of moisture-pickup of granules of the mixture after 72 hours storage at 32° C. and 80% relative humidity. Preferably, the moisture-pickup under these conditions is less than about 6%, more preferably less than about 3.5% and desirably less than about 1.5% by weight of the particulate mixture.

It should be understood that "moisture-pickup" here refers to the weight of moisture gained by the particulate mixture rather than to the absolute level of water contained therein. Absolute moisture content is, of course, one factor determining the moisture-pickup level, other determining factors including the hygroscopicity of the silica or silicate and the nonionic surfactant, the physiochemical interaction of silica or silicate and the nonionic surfactant, and the weight ratio of the two types of material in the particulate mixture. For a given surfactant/silicate pair, the important factors determining moisture-pickup are thus absolute moisture level and the weight ratio of surfactant to silicate. These two factors are also important from the viewpoint of granulometry, however, i.e., they determine granule average size, size distribution, flow characteristics etc. Thus for a given surfactant/silicate pair, both the absolute moisture content and the ratio of surfactant to silicate should be adjusted within the broad limits specified above to provide granules having optimum granulometry and minimum moisture-pickup.

With regard to the water-insoluble silica or silicate, this preferably has an average primary particle size (i.e. number average particle diameter for the primary crystals or primary aggregates as obtained, for instance, from electron microscope measurements) of less than about 4μ, more preferably less than about 1μ, and a pore volume (as obtained for instance, by water adsorption under A.S.T.M. C-20-46) of at least 0.1 cc/g, more preferably at least 0.2 cc/g. Preferably also, the silica or silicate has a pore volume for cavities within the range from 400 Å to 2.5μ of at least 0.05 cc/g (measured in a mercury porosity meter) and an external surface area (measured, for instance, by dye adsorption) of at least 5 sq. meter/g, more preferably at least 15 sq. meter/g.

With regard to chemical composition, the water-insoluble silicate is preferably a sheet-like, natural clay, especially a clay selected from the smectite-type and kaolinite-type groups. Highly preferred from the viewpoint of granulometry, processibility, moisture-pickup, activator stability, and dispersibility are the three-layer expandable clays of the smectite-group, especially alkali and alkaline earth metal montmorillonites, saponites and hectorites. Desirably, these have a moisture content in the range from about 8% to about 20%. Kaolinite-type materials such as kaolinite itself and calcined kaolin and metakaolin are also suitable however. In these cases, moisture content generally lies in the range from about 0.1% to about 18%, more preferably from about 0.3% to about 12%.

Other suitable water-insoluble silicates include aluminosilicates of the zeolite type, particularly those of the general formula:

$$Na_z(AlO_2)_z(SiO_2)_yxH_2O$$

wherein z and y are integers of at least 6, the molar ratio of z to y is in the range from 1.0 to 0.5 and x is a number such that the moisture content of the aluminosilicate is from about 10% to about 28% by weight. Particularly preferred materials of the zeolite class are those prepared from clays themselves, especially A-type zeolites prepared by alkali treatment of calcined kaolin.

The alkoxylated nonionic surfactant is preferably selected to have an average HLB in the range from about 9.5 to 13.5 and to have a melting point of no more than about 32° C., more preferably about 28° C.; these conditions are found to provide granules having the optimum combination of hydrophobicity and water-dispersibility. Highly suitable nonionic surfactants of this type are ethoxylated primary or secondary $C_{9-15}$ alcohols having an average degree of ethoxylation from about 3 to 9.

The water-insoluble silica or silicate, peroxy acid bleach precursor and nonionic surfactant preferably constitute from about 15% to 60%, 5% to 80% and 5% to 40%, more preferably from about 20% to 60%, 5% to 40% and 20% to 40%, of the particulate mixture, respectively. In other words, the particulate mixtures are adapted to contain relatively large amounts of the functional activator and detergent components of the composition in relation to the silica or silicate. Desirably, however, the particulate mixture is essentially free of inorganic per-compounds which yield hydrogen peroxide in water, e.g. sodium perborate tetrahydrate.

The pH characteristics of the bleach activator/silicate/nonionic surfactant matrix is also highly important, and critically, the particulate mixture should have a pH in 2% aqueous dispersion of the particulate mixture of from about 2 to about 9.0, preferably from about 3 to about 8.5, especially from about 4 to about 7. If necessary, optimization of the pH to within the above range can be effected by means of a separate pH regulating agent. Control of pH is important for stabilizing the activator against hydrolytic and perhydrolytic degradation and is particularly effective in this respect in the moisture-controlled environment of the hydrophobic granule.

A further highly preferred though optional component of the composition is a polyphosphonic acid or salt thereof, particularly those having the general formula:

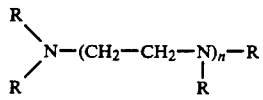

in which n is an integral number from 1 to 14 and each R is individually hydrogen or $CH_2PO_3H_2$ or a water-soluble salt thereof, provided that at least half of the radicals represented by R are $CH_2PO_3H_2$ radicals or water-soluble salts thereof. Especially preferred are diethylene triamine penta (methylene phosphonic acid); ethylene diamine tetra (methylene phosphonic acid) and salts thereof. These can be included either in the particulate mixture or in the remainder of the composition in levels of from about 0.5% to about 10%, preferably about 1% to about 5% by weight of the particulate mixture or about 0.1% to 4% by weight of the total composition. The polyphosphonates have been found to be uniquely effective in stabilizing organic peroxyacids against the generally deleterious effect of water-insoluble silicates, especially those belonging to the zeolite and kaolin classes. Accordingly, a highly preferred embodiment of the invention is a granular detergent composition comprising from about 0.5% to 100% of a particulate mixture comprising:

(a) a finely-divided, water-insoluble natural or synthetic silica or silicate having an average primary particle size of less than 10μ and a moisture content of from 0.1 to 30%, and (b) a finely-divided organic peroxy acid bleach precursor in a weight ratio of (a) to (b) of from 20:1 to 1:10, and wherein the composition additionally comprises (c) a polyphosphonic acid or salt thereof as defined above, the weight ratio of (a) to (c) falling in the range from 100:1 to 1:1.

Another highly preferred component of the composition of the invention is a water-soluble cationic surfactant which is incorporated in the particulate mixture in a level from about 5% to about 40% thereof. Especially suitable water-soluble surfactants have the general formula:

$$R^1{}_mR^2{}_{4-m}N^+Z$$

wherein $R^1$ is selected from $C_{8-20}$ alkyl, alkenyl and alkaryl groups; $R^2$ is selected from $C_{1-4}$ alkyl, and benzyl groups; Z is an anion in number to give electrical neutrality; and m is 1, 2, or 3, provided that when m is 2, $R^1$ has less than 15 carbon atoms and when m is 3, $R^1$ has less than 9 carbon atoms.

Apart from providing a detergency function, the water-soluble cationic surfactant also contributes towards reducing moisture-pickup and improving the granulometry of the particulate mixture.

The granular detergent composition can consist solely of the particulate mixture, in which case the composition is designed for use primarily as an additive product simultaneously with a conventional bleach-containing detergent composition, or it can consist of a combination of the particulate mixture with conventional auxiliary detergent components. In the latter instance, a preferred composition comprises:

(a) from about 0.5% to about 60%, preferably from about 5% to about 60%, of the particulate mixture, and (b) from about 40% to about 99.5%, preferably from about 40% to about 95%, of auxiliary detergent components in powder form comprising:

(i) about 5% to about 35% of an inorganic percompound, yielding hydrogen peroxide in water, (ii) about 1% to about 30% of an anionic surfactant, optionally in combination with a nonionic, cationic, zwitterionic, ampholytic surfactant or mixture thereof, and (iii) about 2% to about 93.5%, preferably about 2% to about 89% of a detergency builder.

In a method of making the compositions of the invention, the alkoxylated nonionic surfactant is dispersed in liquid form onto a moving bed of a mixture of the water-insoluble silica or silicate and organic peroxy acid bleach precursor to form agglomerates which are then admixed with the auxiliary detergent components, if any, of the composition. The process can be performed in, for instance, a pan agglomerator, Schugi mixer or fluidized bed apparatus.

The various components of the compositions of the invention will now be discussed in more detail.

THE WATER-INSOLUBLE SILICA OR SILICATE

As described earlier, the water-insoluble silica or silicate is preferably a mineral clay selected from the smectite-type and kaolinite-type groups.

There are two distinct classes of smectite clays that can be broadly differentiated on the basis of the numbers of octahedral metal-oxygen arrangements in the central layer for a given number of silicon-oxygen atoms in the outer layers. The dioctahedral minerals are primarily trivalent metal ion-based clays and are comprised of the prototype pyrophyllite and the members montmorillonite $(OH)_4Si_{8-y}Al_y\ (Al_{4-x}Mg_x)O_{20}$, nontronite $(OH)_4Si_{8-y}Al_y(Al_{4-x}Fe_x)O_{20}$, and volchonskoite $(OH)_4Si_{8-y}Al_y\ (Al_{4-x}Cr_x)O_{20}$, where x has a value of from 0 to about 4.0 and y has a value of from 0 to about 2.0.

The trioctahedral minerals are primarily divalent metal ion based and comprise the prototype talc and the members hectorite $(OH)_4Si_{8-y}Al_y(Mg_{6-x}Li_2)O_{20}$, saponite $(OH)_4(Si_{8-y}Al_y)\ (Mg_{6-x}Al_x)O_{20}$, sauconite $(OH)_4Si_{8-y}Al_y(Zn_{6-x}Al_x)O_{20}$, vermiculite $(OH)_4Si_{8-y}Al_y(Mg_{6-x}Fe_x)O_{20}$, wherein y has a value of 0 to about 2.0 and x has a value of 0 to about 6.0.

While all of the above smectite-type clays can be incorporated in the compositions of the invention, particularly preferred smectite-type clays have ion-exchange capacities of at least 50 meq/100 g clay (measured, for instance, as described, in "The Chemistry and Physics of Clays," p.p. 264–265, Interscience (1979)). Especially preferred materials of this type include alkali and alkaline earth metal montmorillonites, saponites and hectorites, specific examples of which are as follows:

Sodium Montmorillonite

Brock
Volclay BC
Gelwhite GP
Thixo-Jel 1
Ben-A-Gel
Imvite

Sodium Hectorite

Veegum F
Laponite SP

Sodium Saponite

Barasym NAS 100

Calcium Montmorillonite

Soft Clark
Gelwhite L

Lithium Hectorite

Barasym LIH 200

Smectite-type clays as described above, having a primary particle size of less than about 0.05μ and an external surface area greater than about 15 $m^2/g$, preferably greater than about 50 $m^2/g$ are particularly suitable in the present compositions. In practice however, these clays tend to exist as larger-sized agglomerates having agglomerate size of from about 1μ to about 75μ. Their moisture content is preferably adjusted to within the range from about 8% to about 20%, especially from about 10% to 15% by weight of the clay.

Turning to the kaolinite-type clays, kaolinite itself is well-recognized as a light-coloured, powdery material having the approximate formula:

$$Al_2O_3SiO_22H_2O$$

and a specific gravity of about 2.6. The kaolinites useful in the present invention are naturally derived, i.e. they are not synthetic minerals and in consequence often contain minor proportions (<2%) of iron, calcium, magnesium and titanium oxides. The kaolinites may be subjected to special processing, e.g. by calcining to give metakaolin of approximate formula $Al_2Si_2O_7$, or may be surface modified with inorganic materials such as alumina. The kaolinite clays should have a mean particle size of less than about 1 micron, preferably less than 0.5 microns and preferred clays also have a specific surface of at least 10 $m^2$/gram; most preferably at least 15 $m^2$/gram.

Because kaolinite clays are non-swelling in character, their particle size in the dry state is substantially the same as that in the wet (dispersed) state. In this context, particularly useful commercially available kaolinite clays are those which are treated by the so-called "wet process" i.e., are purified by a water washing procedure and are accordingly in a "dispersed" form.

Specific non-limiting examples of commercial kaolinite clays useful herein include Hydrite 10, Kaophile 2 and Hydrite UF, all available from the Georgia Kaolin Company, Hydrasperse and Hydrasheen 90, available from the J. M. Huber Corporation and Kaolin M100 available from English China Clays.

Other suitable water-insoluble silicates include aluminosilicates of the zeolite-type, particularly those of the general formula:

$$Na_z(AlO_2)_z(SiO_2)_yxH_2O$$

wherein z and y are integers of at least 6, the molar ratio of z to y is in the range from 1.0 to 0.5 and x is a number such that the moisture content of the aluminosilicate is from about 10% to about 28% by weight. Preferred aluminosilicates of this type belong to the faujasite group and include faujasite itself and the synthetic zeolites A, X and Y conventionally represented by the following formulae:

| | |
|---|---|
| $Na_{12}(AlO_2)_{12}(SiO_2)_{12}.27H_2O$ | Zeolite A |
| $Na_{86}(AlO_2)_{86}(SiO_2)_{106}264H_2O$ | Zeolite X |
| $Na_6(AlO_2)_6(SiO_2)_{10}15H_2O$ | Zeolite Y |

Highly preferred zeolites are prepared from metakaolin by treatment at about 80°–100° C. either with alkali alone (in the case of zeolites having a 1:1 $AlO_2$:$SiO_2$ ratio such as Zeolite A) or with mixtures of alkali and additional silica provided, for instance, in the form of sodium silicate or colloidal silica (in the case of zeolites having $AlO_2$:$SiO_2$ ratios of less than 1, e.g. Zeolite X).

Preferably, the aluminosilicates have an average primary particle size of less than about 4 microns, especially less than about 1 micron, and an external surface area in excess of about 5 $m^2$/g, especially greater than about 10 $m^2$/g.

Other suitable water-insoluble silicas or silicates include those having an amorphous or gel-like structure, for example, silica aerogels, amorphous aluminosilicates, precipitated silica, silica xerogels, fumed silica, and magnesium silicates of formula nMgO:$SiO_2$ wherein n is from about 0.25 to 4.0, preferably about 0.3 to 1.5, for example 0.3125.

THE ORGANIC PEROXYACID BLEACH PRECURSOR

Organic peroxy compound precursors, or inorganic per salt activators as they are usually known, are well known in the art and are described extensively in the literature.

Examples of various classes of peroxy compound precursors include:

(a) Esters

Esters suitable as peroxy compound precursors in the present invention include esters of monohydric substituted and unsubstituted phenols, substituted aliphatic alcohols in which the substituent group is electron withdrawing in character, mono- and disaccharides, N-substituted derivatives of hydroxylamine and esters of imidic acids. The phenol esters of both aromatic and aliphatic mono- and dicarboxylic acids can be employed. The aliphatic esters can have 1 to 20 carbon atoms in the acyl group, examples being phenyl laurate, phenyl myristate, phenyl palmitate and phenyl stearate. Of these, o-acetoxy benzoic acid and methyl o-acetoxy benzoate are especially preferred. Diphenyl succinate, diphenyl azeleate and diphenyl adipate are examples of phenyl aliphatic dicarboxylic acid esters. Aromatic esters include phenyl benzoate, diphenyl phthalate and diphenyl isophthalate.

A specific example of an ester of a substituted aliphatic alcohol is trichloroethyl acetate. Examples of saccharide esters include glucose pentaacetate and sucrose octaacetate. An exemplary ester of hydroxylamine is acetyl aceto hydroxamic acid.

These and other esters suitable for use as peroxy compound precursors in the present invention are fully described in British patent specification Nos. 836988 and 1147871.

A further group of esters are the acyl phenol sulphonates and acyl alkyl phenol sulphonates. Examples of the former include sodium acetyl phenol sulphonate (alternatively described as sodium p-acetoxy benzene sulphonate) and sodium benzoyl phenol sulphonate (alternatively described as sodium p-benzoyloxy benzene sulphonate). Examples of acyl alkyl phenol sulphonates include sodium 2-acetoxy 5-dodecyl benzene sulphonate, sodium 2-acetoxy 5-hexyl benzene sulphonate and sodium 2-acetoxy capryl benzene sulphonate. The preparation and use of these and analogous compounds is given in British patent specification Nos. 963135 and 1147871.

Esters of imidic acids have the general formula:

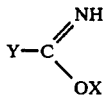

wherein X is substituted or unsubstituted $C_1$–$C_{20}$ alkyl or aryl and Y can be the same as X and can also be—$NH_2$. An example of this class of compounds is ethyl benzimidate wherein Y is $C_6H_5$ and X is ethyl.

Other specific esters include p-acetoxy acetophenone and 2,2-di-(4-hydroxyphenyl) propane diacetate. This last material is the diacetate derivative of 2,2-di(4-hydroxyphenyl) propane more commonly known as Bisphenol A which is an intermediate in the manufacture of polycarbonate resins. Bisphenol A diacetate and methods for its manufacture are disclosed in German DAS No. 1260479 published February 8th, 1968 in the name of VBB Chemiefaserwork Schwarza "Wilhelm Piesh."

(b) Imides

Imides suitable as organic peroxy compound precursors in the present invention are compounds of formula:

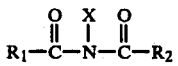

in which $R_1$ and $R_2$, which can be the same or different are independently chosen from a $C_1$–$C_4$ alkyl group or an aryl group and X is an alkyl, aryl or acyl radical (either carboxylic or sulphonic). Typical compounds are those in which $R_1$ is a methyl, ethyl, propyl or phenyl group but the preferred compounds are those in which $R_2$ is also methyl, examples of such compounds being N,N-diacetylaniline, N,N-diacetyl-p-chloroaniline and N,N-diacetyl-p-toluidine. Either one of $R_1$ and $R_2$ together with X may form a heterocyclic ring containing the nitrogen atom. An illustrative class having this type of structure is the N-acyl lactams, in which the nitrogen atom is attached to two acyl groups, one of which is also attached to the nitrogen in a second position through a hydrocarbyl linkage. A particularly preferred example of this class is N-acetyl caprolactam. The linkage of the acyl group to form a heterocyclic ring may itself include a heteroatom, for example oxygen, and N-acyl saccharides are a class of precursors of this type.

Examples of cyclic imides in which the reactive centre is a sulphonic radical are N-benzene sulphonyl phthalimide, N-methanesulphonyl succinimide and N-benzene sulphonyl succinimide. These and other N-sulphonyl imides useful herein are described in British patent specification No. 1242287.

Attachment of the nitrogen atoms to three acyl groups occurs in the N-acylated dicarboxylic acid imides such as the N-acyl phthalimides, N-acyl succinimides, N-acyl adipimides and N-acyl glutarimides. Imides of the above-mentioned types are described in British patent specification No. 855735 the disclosures of which are hereby incorporated specifically herein by reference.

Two further preferred groups of materials in this class are those in which X in the above formula is either a second diacylated nitrogen atom i.e. substituted hydrazines, or a difunctional hydrocarbyl groups such as a $C_1$–$C_6$ alkylene group further substituted with a diacylated nitrogen atom i.e. tetra acylated alkylene diamines.

Particularly preferred compounds are N,N,N',N'-tetra acetylated compounds of formula:

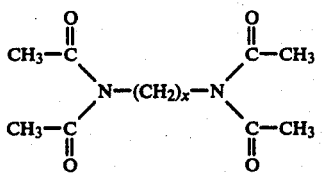

in which x can be 0 or an integer between 1 and 6, examples are tetra acetyl methylene diamine (TAMD) where x=1, tetra acetyl ethylene diamine (TAED) where x=2, and tetra acetyl hexamethylene diamine (TAHD) where x=6. Where x=0 the compound is tetra acetyl hydrazine (TAH). These and analogous compounds are described in British patent specification Nos. 907,356, 907,357, and 907,358.

Acylated glycourils form a further group of compounds falling within the general class of imide peroxy compound precursors. These materials have the general formula:

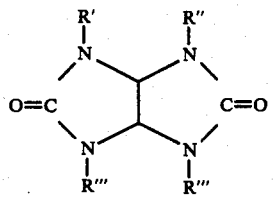

in which at least two of the R groups represent acyl radicals having 2 to 8 carbon atoms in their structure. The preferred compound is tetra acetyl glycouril in which the R groups are all $CH_3CO$- radicals. The acylated glycourils are described in British patent specification Nos. 1246338, 1246339, and 1247429.

Other imide-type compounds suitable for use as peroxy compound precursors in the present invention are the N-(halobenzoyl) imides disclosed in British patent specification No. 1247857, of which N-m-chloro benzoyl succinimide is a preferred example, and poly imides containing an N-bonded-COOR group, e.g. N-methoxy carbonyl phthalimide, disclosed in British patent specification No. 1244200.

N-acyl and N,N'-diacyl derivatives of urea are also useful peroxy compound percursors for the purposes of the present invention, in particular N-acetyl dimethyl urea, N,N'-diacetyl ethylene urea and N,N'-diacetyl dimethyl urea. Compounds of this type are disclosed in Netherlands Patent Application No. 6504416 published Oct. 10th 1966. Other urea derivatives having inorganic persalt activating properties are the mono- and di-N-acylated azolinones disclosed in British patent specification No. 1379530.

Acylated hydantoin derivatives also fall within this general class of organic peroxy compound percursors. The hydantoins may be substituted e.g. with lower alkyl groups and one or both nitrogen atoms may be acylated. Examples of compounds of this type are N-acetyl hydantoin, N,N-diacetyl, 5,5-dimethyl hydantoin, 1-phenyl, 3-acetyl hydantoin and 1-cyclohexyl, 3-acetyl hydantoin. These and similar compounds are described in British patent specification Nos. 965672 and 1112191.

Another class of nitrogen compounds of the imide type are the N,N-diacyl methylene diformamides of which N,N-diacetyl methylamine diformamide is the preferred member. This material and analogous compounds are disclosed in British patent specification No. 1106666.

(c) Imidazoles

N-acyl imidazoles and similar five-membered ring systems form a further series of compounds useful as inorganic peroxy compound precursors. Specific examples are N-acetyl benzimidazole, N-benzoyl imidazole and its chloro- and methyl-analogues. Compounds of this type are disclosed in British patent specification Nos. 1234762, 1311765 and 1395760.

(d) Oximes

Oximes and particularly acylated oximes are also a useful class of organic peroxy compound precursors for the purpose of this invention. Oximes are derivatives of hydroxylamine from which they can be prepared by reaction with aldehydes and ketones to give aldoximes and ketoximes respectively. The acyl groups may be $C_1$–$C_{12}$ aliphatic or aromatic in character, preferred acyl groups being acetyl, propionyl, lauroyl, myristyl and benzoyl. Compounds containing more than one carbonyl group can react with more than one equivalent of hydroxylamine and the commonest class of dioximes are those derived from 1,2-diketones and ketonic aldehydes, such as dimethyl glyoxime

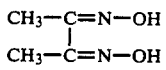

The acylated derivatives of this compound are of particular value as organic peroxy compound precursors, examples being diacetyl dimethyl glyoxime, dibenzoyl dimethyl glyoxime and phthaloyl dimethyl glyoxime.

(e) Carbonates

Substituted and unsubstituted aliphatic, aromatic and alicyclic esters of carbonic and pyrocarbonic acid have also been proposed as organic peroxy compound precursors. Typical examples of such esters are p-carboxy phenyl ethyl carbonate, sodium-p-sulphophenyl ethyl carbonate, sodium-p-sulphophenyl n-propyl carbonate and diethyl pyrocarbonate. The use of such esters as inorganic persalt activators in detergent compositions is set forth in British patent specification No. 970950.

In addition to the foregoing classes, numerous other materials can be utilised as organic peroxy compound precursors including triacyl guanidines of formula:

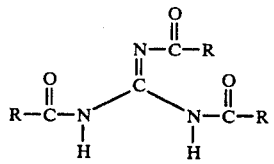

wherein R is alkyl, preferably acetyl or phenyl, prepared by the acylation of a guanidine salt. Other classes of compounds include acyl sulphonamides, e.g. N-phenyl N-acetyl benzene sulphonamide as disclosed in British patent specification No. 1003310 and triazine derivatives such as those disclosed in British patent specification Nos. 1104891 and 1410555. Particularly preferred examples of triazine derivatives are the di- and triacetyl derivatives of 2,4,6,-trihydroxy-1,3,5-triazine, 2-chloro-4,6-dimethoxy-S-triazine and 2,4-dichloro 6-methoxy-S-triazine. Piperazine derivatives such as 1,4-diacylated 2,5-diketo piperazine as described in British patent specification Nos. 1339256 and 1339257 are also useful as are water soluble alkyl and aryl chloroformates such as methyl, ethyl and phenyl chloroformate disclosed in British patent specification No. 1242106.

Of the foregoing classes of activators, the preferred classes are those that produce a peroxycarboxylic acid on reaction with an inorganic persalt. In particular the preferred classes are the imides, oximes and esters especially the phenol esters and imides.

Specific preferred materials are solid and are incorporated in the instant compositions in finely divided form, i.e., with an average particle size of less than about 500μ, more preferably less than about 350μ, especially less than about 150μ. Highly preferred materials include methyl o-acetoxy benzoate, sodium-p-acetoxy benzene sulphonate, Bisphenol A diacetate, tetra acetyl ethylene diamine, tetra acetyl hexamethylene diamine and tetra-acetyl methylene diamine.

THE NONIONIC SURFACTANT

An alkoxylated nonionic synthetic detergent is a further essential component of the instant compositions. Such nonionic detergent materials can be broadly defined as compounds produced by the condensation of alkylene oxide groups (hydrophilic in nature) with an organic hydrophobic compound, which may be aliphatic or alkyl aromatic in nature. The length of the polyoxyalkylene group which is condensed with any particular hydrophobic group can be readily adjusted to yield a water-soluble compound having the desired degree of balance between hydrophilic and hydrophobic elements.

Examples of suitable nonionic detergents include: 1. The polyethylene oxide condensates of alkyl phenol, e.g. the condensation products of alkyl phenols having an alkyl group containing from 6 to 12 carbon atoms in either a straight chain or branched chain configuration, with ethylene oxide, the said ethylene oxide being present in amounts equal to 5 to 15 moles of ethylene oxide per mole of alkyl phenol. The alkyl substituent in such compounds may be derived, for example, from polymerised propylene, di-isobutylene, octene and nonene. Other examples include dodecylphenol condensed with 9 moles of ethylene oxide per mole of phenol; dinonylphenol condensed with 11 moles of ethylene oxide per mole of phenol; nonylphenol and di-iso-octylphenol condensed with 12 moles of ethylene oxide.

2. The condensation product of primary or secondary aliphatic alcohols having from 8 to 24 carbon atoms, in either straight chain or branched chain configuration, with from 1 to about 18 moles of alkylene oxide per mole of alcohol. Preferably, the aliphatic alcohol comprises between 9 and 15 carbon atoms and is ethoxylated with between 2 and 12, desirably between 3 and 9 moles of ethylene oxide per mole of aliphatic alcohol. Such nonionic surfactants are preferred from the point of view of providing good to excellent detergency performance on fatty and greasy soils, and in the presence of hardness sensitive anionic surfactants such as alkyl benzene sulfonates. The preferred surfactants are prepared from primary alcohols which are either linear (such as those derived from natural fats or, prepared by the Ziegler process from ethylene, e.g. myristyl, cetyl, stearyl alcohols), or partly branched such as the Dobanols and Neodols which have about 25% 2-methyl branching (Dobanol and Neodol being Trade Names of Shell) or Synperonics, which are understood to have about 50% 2-methyl branching (Synperonic is a Trade Name of I.C.I.) or the primary alcohols having more than 50% branched chain structure sold under the Trade Name Lial by Liquichimica. Specific examples of nonionic surfactants falling within the scope of the invention include Dobanol 45-4, Dobanol 45-7, Dobanol 45-9, Dobanol 91-3, Dobanol 91-6, Dobanol 91-8, Synperonic 6, Synperonic 14 and the condensation products of coconut alcohol with an average of between 5 and 12 moles of ethylene oxide per mole of alcohol, the coconut alkyl portion having from 10 to 14 carbon atoms. Secondary linear alkyl ethoxylates are also suitable in the present compositions, especially those ethoxylates of the Tergitol series having from about 9 to 15 carbon atoms in the alkyl group and up to about 11, especially from about 3 to 9, ethoxy residues per molecule.

3. The compounds formed by condensing ethylene oxide with a hydrophobic base formed by the condensation of propylene oxide with propylene glycol. The molecular weight of the hydrophobic portion generally falls in the range of about 1500 to 1800. Such synthetic nonionic detergents are available on the market under the Trade Name of "Pluronic" supplied by Wyandotte Chemicals Corporation.

Of the above, highly preferred are alkoxylated nonionic surfactants having an average HLB in the range from about 9.5 to 13.5, especially 10 to 12.5 as this is found to provide granules having the optimum combination of hydrophobicity and water-dispersibility. Preferably, also the melting point of the nonionic surfactant is no more than about 32° C., more preferably no more than about 28° C. Highly suitable nonionic surfactants of this type are ethoxylated primary or secondary $C_{9-15}$ alcohols having an average degree of ethoxylation from about 3 to 9, more preferably from about 5 to 8. The nonionic surfactants are incorporated in a silicate/nonionic weight ratio of from about 20:1 to 1:3, preferably from about 10:1 to 1:1, especially from about 3:1 to about 5:4.

OPTIONAL COMPONENTS

Various optional ingredients can be incorporated into the composition of the present invention in order to increase its efficacy particularly in the area of stain removal. The total amount of such optional ingredients normally lies in the range 1%–70%, preferably 1%–30% of the particulate mixture when incorporated directly therein, or in the range 40%–99.5% preferably 50%–80% when incorporated in the remainder of the composition. The most preferred optional ingredients are those that enhance the removal of stains of an oily nature, or those susceptible to bleaching.

In the former category, the addition of a water-soluble cationic surfactant to the present compositions has been found to be useful. Suitable cationic surfactants are those having a critical micelle concentration for the pure material of at least 200 p.p.m. and preferably at least 500 p.p.m. specified at 30° C. and in distilled water. Literature values are taken where possible, especially surface tension or conductimetric values—see Critical Micelle Concentrations of Aqueous Surfactant System, P. Mukerjee and K.J. Mysels, NSRDS—NBS 36 (1971).

A highly preferred group of cationic surfactants of this type have the general formula:

$$R^1{}_mR^2{}_{4-m}N\ Z$$

wherein $R^1$ is selected from $C_8$–$C_{20}$ alkyl, alkenyl and alkaryl groups; $R^2$ is selected from $C_1$–$C_4$ alkyl and benzyl groups; Z is an anion in number to give electrical neutrality; and m is 1, 2 or 3; provided that when m is 2 $R^1$ has less than 15 carbon atoms and when m is 3, $R^1$ has less than 9 carbon atoms.

Where m is equal to 1, it is preferred that $R^2$ is a methyl group. Preferred compositions of this monolong chain type include those in which $R^1$ is a $C_{10}$ to $C_{16}$ alkyl group. Particularly preferred compositions of this class include $C_{12}$ alkyl trimethylammonium halide and $C_{14}$ alkyl trimethylammonium halide.

Where m is equal to 2, the $R^1$ chains should have less than 14 carbon atoms. Particularly preferred cationic materials of this class include di-$C_8$ alkyldimethylammonium halide and di-$C_{10}$ alkyldimethylammonium halide materials.

Where m is equal to 3, the $R^1$ chains should be less than 9 carbon atoms in length. An example is trioctyl methyl ammonium chloride.

Another highly preferred group of cationic compounds have the general formula:

$R^1R^2{}_mR^3{}_{3-m}N^+A$ wherein $R^1$ represents a $C_{6-24}$ alkyl or alkenyl group or a $C_{6-12}$ alkaryl group, each $R^2$ independently represents a $(C_nH_{2n}O)_xH$ group where n is 2, 3 or 4 and x is from 1 to 14, the sum total of $C_nH_{2n}O$ groups in $R^2{}_m$ being from 1 to 14, each $R^3$ independently represents a $C_{1-12}$ alkyl or alkenyl group, an aryl group or a $C_{1-6}$ alkaryl group, m is 1, 2 or 3, and A is an anion.

In this group of compounds, $R^1$ is selected from $C_{6-24}$ alkyl or alkenyl groups and $C_{6-12}$ alkaryl groups; $R^3$ is selected from $C_{1-12}$ alkyl or alkenyl groups and $C_{1-6}$ alkaryl groups. When m is 2, however, it is preferred that the sum total of carbon atoms in $R^1$ and $R^3{}_{3-m}$ is no more than about 20 with $R^1$ representing a $C_{8-18}$ alkyl or alkenyl group. More preferably the sum total of carbon atoms in $R^1$ and $R^1{}_{3-m}$ is no more than about 17 with $R^1$ representing a $C_{10-16}$ alkyl or alkenyl group. When m is 1, it is again preferred that the sum total of carbon atoms in $R^1$ and $R^3{}_{3-m}$ is no more than about 17 with $R^1$ representing a $C_{10-16}$ alkyl or alkaryl group.

Additionally in this group of compounds, the total number of alkoxy radicals in polyalkoxy groups ($R^2{}_m$) directly attached to the cationic charge centre should be no more than 14. Preferably, the total number of such alkoxy groups is from 1 to 7 with each polyalkoxy group ($R^2$) independently containing from 1 to 7 alkoxy groups; more preferably, the total number of such alkoxy groups is from 1 to 5 with each polyalkoxy group ($R^2$) independently containing from 1 to 3 alkoxy groups. Especially preferred are cationic surfactants having the formula:

$$R^1(C_nH_{2n}OH)_m(CH_3)_{3m}\ N^+A$$

wherein $R^1$ is as defined immediately above, n is 2 or 3 and m is 1, 2 or 3.

Particularly preferred cationic surfactants of the class having m equal to 1 are dodecyl dimethyl hydroxyethyl ammonium salts, dodecyl dimethyl hydroxypropyl ammonium salts, myristyl dimethyl hydroxyethyl ammonium salts and dodecyl dimethyl dioxyethylenyl ammonium salts. When m is equal to 2, particularly preferred cationic surfactants are dodecyl dihydroxyethyl methyl ammonium salts, dodecyl dihydroxypropyl methyl ammonium salts, dodecyl dihydroxyethyl ethyl ammonium salts, myristyl dihydroxyethyl methyl ammonium salts, cetyl dihydroxyethyl methyl ammonium salts, stearyl dihyroxyethyl methyl ammonium salts, oleyldihyroxyethyl methyl ammonium salts, and dodecyl hydroxy ethyl hydroxypropyl methyl ammonium salts. When m is 3, particularly preferred cationic surfactants are dodecyl trihydroxyethyl ammonium salts, myristyl trihydroxyethyl ammonium salts, cetyl trihydroxyethyl ammonium salts, stearyl trihydroxyethyl ammonium salts, oleyl trihydroxy ethyl ammonium salts, dodecyl dihydroxyethyl hydroxypropyl ammonium salts and dodecyl trihydroxypropyl ammonium salts.

In the above, the usual inorganic salt counterions can be employed, for example, chlorides, bromides and borates. Salt counterions can also be selected from organic acid anions, however, such as the anions derived from organic sulphonic acids and from sulphuric acid esters. A preferred example of an organic acid anion is a $C_{6-12}$ alkaryl sulphonate.

Of all the above cationic surfactants, especially preferred are dodecyl dimethyl hydroxyethyl ammonium salts and dodecyl dihydroxyethyl methyl ammonium salts.

Another group of useful cationic compounds are the polyammonium salts of the general formula:

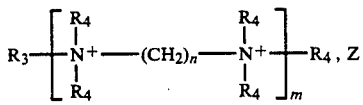

wherein $R_3$ is selected from $C_8$ to $C_{20}$ alkyl, alkenyl and alkaryl groups; each $R_4$ is $C_{1-4}$ alkyl; n is from 1 to 6; and m is from 1 to 3.

A specific example of a material in this group is:

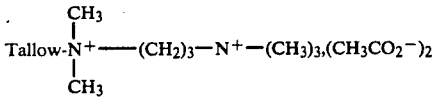

(1)

A further preferred type of cationic component, which is described in Japanese Patent Application No. 79-39413 and incorporated herein by reference, has the formula:

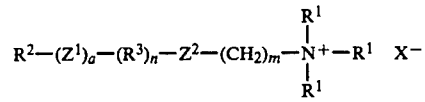

wherein $R^1$ is $C_1$ to $C_4$ alkyl; $R^2$ is $C_5$ to $C_{30}$ straight or branched chain alkyl or alkenyl, alkyl benzene, or

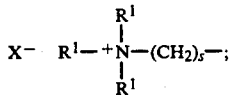

wherein s is from 0 to 5, $R^3$ is $C_1$ to $C_{20}$ alkyl or alkenyl; a is 0 or 1; n is 0 or 1; m is from 1 to 5; $Z^1$ and $Z^2$ are each selected from the group consisting of:

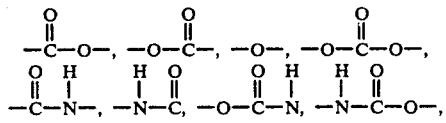

and wherein at least one of said groups is selected from the group consisting of ester, reverse ester, amide and reverse amide; and X is an anion which makes the compound water-soluble, preferably selected from the group consisting of halide, methyl sulfate, hydroxide, and nitrate, preferably chloride, bromide or iodine.

In addition to the advantages of the other cationic surfactants disclosed herein, this particular cationic component is environmentally desirable, since it is biodegradable, both in terms of its long alkyl chain and its nitrogen-containing segment.

Particularly preferred cationic surfactants of this type are the choline ester derivatives having the following formula:

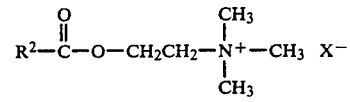

as well as those wherein the ester linkage in the above formula is replaced with a reverse ester, amide or reverse amide linkage.

Particularly preferred examples of this type of cationic surfactant include caproyl choline ester quaternary ammonium halides ($R^2=C_9$ alkyl), palmitoyl choline ester quaternary ammonium halides ($R^2=C_{15}$ alkyl), myristoyl choline ester quaternary ammonium halides ($R^2=C_{13}$ alkyl) and lauroyl choline ester ammonium halides ($R^2=C_{11}$ alkyl).

Additional preferred cationic surfactants are fully disclosed in British patent application No. 79-25946 and incorporated herein by reference.

The above water-soluble cationic surfactants can be employed in nonionic/cationic surfactant mixtures in a weight ratio of from about 10:6 to about 20:1, more preferably from about 10:2 to about 10:6, and particularly from about 10:3 to 10:5.

As mentioned earlier, a pH regulating agent can be added to provide the necessary pH control, suitable regulating agents being selected from inorganic or organic acids or acid salts or mixtures of such materials. Preferred inorganic agents include sodium and potassium bicarbonates, acid pyrophosphates, acid orthophosphates, bisulfates and boric acid. Suitable organic agents include lactic acid, glycollic acid and ether derivatives thereof as disclosed in Belgium Pat. Nos. 821,368, 821,369 and 821,370; succinic acid, malonic acid, (ethylenedioxy) diacetic acid, maleic acid, diglycollic acid, tartaric acid, tartronic acid and fumaric acid, citric acid, aconitic acid, citraconic acid, carboxymethyloxy succinic acid, lactoxysuccinic acid, and 2-oxa-1,1,3-propane tricarboxylic acid; oxydisuccinic acid, 1,1,2,2-ethane tetracarboxylic acid, 1,1,3,3-propane tetracarboxylic acid and 1,1,2,3-propane tetracarboxylic acid; cyclopentane-cis, cis, cis-tetracarboxylic acid, cyclopentadienide pentacarboxylic acid, 2,3,4,5-tetrahydrofuran-cis, cis, cis-tetracarboxylic acid, 2,5-tetrahydrofuran-cis-cis dicarboxylic acid, 1,2,3,4,5,6-hexane-hexacarboxylic acid mellitic acid, pyromellitic acid and the phthalic acid derivatives disclosed in British Pat. No. 1,425,343; ethylene diamine tetra(methylenephosphonic acid), diethylene triamine penta(methylenephosphonic acid) and the acid salts of the above organic acids. Of the above, the preferred organic acids are citric, glycollic and lactic acids and the two phosphonic acids.

Where necessary or desirable, the pH regulating agent is present in the particulate mixture in an amount sufficient to provide a pH in 2% aqueous solution of the detergent composition, in the range from about 2 to 9.0, preferably from about 3 to 8.5, especially from about 4 to 7. If the detergent compositions contain perborate, however, the pH is preferably less than about 7 under these conditions. Generally, from about 0.5% to 25%, especially from about 1 to 10% of the regulating agent by weight of the particulate mixture is sufficient.

Other optional ingredients which can be added to the present composition either as part of the particulate mixture or as a separate particulate admixture include surfactants other than the nonionic and cationic surfactants specified hereinbefore, suds modifiers, chelating agents, anti-redeposition and soil suspending agents, optical brighteners, bactericides, anti-tarnish agents, enzymatic materials, fabric softeners, antistatic agents, perfumes, bleach catalysts and detergency builders.

The surfactant can be any one or more surface active agents selected from anionic, zwitterionic, non-alkoxylated nonionic and amphoteric classes and mixtures thereof. Specific examples of each of these classes of compounds are disclosed in Laughlin & Heuring U.S. Pat. No. 3,929,678 issued Dec. 30, 1975 which is hereby specifically incorporated herein by reference.

Suitable synthetic anionic surfactants are water-soluble salts of alkyl benzene sulfonates, alkyl sulfates, alkyl polyethoxy ether sulfates, paraffin sulfonates, alpha-olefin sulfonates, alpha-sulfo-carboxylates and their esters, alkyl glyceryl ether sulfonates, fatty acid monoglyceride sulfates and sulfonates, alkyl phenol polyethoxy ether sulfates, 2-acyloxy-alkane-1-sulfonate, and beta-alkyloxy alkane sulfonate.

A particularly suitable class of anionic surfactants includes water-soluble salts, particularly the alkali metal, ammonium and alkanolammonium salts or organic sulfuric reaction products having in their molecular structure an alkyl or alkaryl group containing from about 8 to about 22, especially from about 10 to about 20 carbon atoms and a sulfonic acid or sulfuric acid ester group. (Included in the term "alkyl" is the alkyl portion of acyl groups). Examples of this group of synthetic detergents which form part of the detergent compositions of the present invention are the sodium and potassium alkyl sulfates, especially those obtained by sulfating the higher alcohols ($C_{8-18}$) carbon atoms produced by reducing the glycerides of tallow or coconut oil and sodium and potassium alkyl benzene sulfonates, in which the alkyl group contains from about 9 to about 15, especially about 11 to about 13, carbon atoms, in straight chain or branched chain configuration, e.g. those of the type described in U.S. Pat. Nos. 2,220,099 and 2,477,383 and those prepared from alkylbenzenes obtained by alkylation with straight chain chloroparaffins (using aluminium trichloride catalysis) or straight chain olefins (using hydrogen fluoride catalysis). Especially valuable are linear straight chain alkyl benzene sulfonates in which the average of the alkyl group is about 11.8 carbon atoms, abbreviated as $C_{11.8}$ LAS.

Other anionic detergent compounds herein include the sodium $C_{10-18}$ alkyl glyceryl ether sulfonates, especially those ethers of higher alcohols derived from tallow and coconut oil; sodium coconut oil fatty acid monoglyceride sulfonates and sulfates; and sodium or potassium salts of alkyl phenol ethylene oxide ether sulfate containing about 1 to about 10 units of ethylene oxide per molecule and wherein the alkyl groups contain about 8 to about 12 carbon atoms.

Other useful anionic detergent compounds herein include the water-soluble salts or esters of $\alpha$-sulfonated fatty acids containing from about 6 to 20 carbon atoms in the fatty acid group and from about 1 to 10 carbon atoms in the ester group; water-soluble salts of 2-acyloxyalkane-1-sulfonic acids containing from about 2 to 9 carbon atoms in the acyl group and from about 9 to about 23 carbon atoms in the alkane moiety; alkyl ether sulfates containing from about 10 to 18, especially about 12 to 16, carbon atoms in the alkyl group and from about 1 to 12, especially 1 to 6, more especially 1 to 4 moles of ethylene oxide; water-soluble salts of olefin sulfonates containing from about 12 to 24, preferably about 14 to 16, carbon atoms, especially those made by reaction with sulfur trioxide followed by neutralization under conditions such that any sultones present are hydrolysed to the corresponding hydroxy alkane sulfonates; water-soluble salts of paraffin sulfonates containing from about 8 to 24, especially 14 to 18 carbon atoms, and $\beta$-alkyloxy alkane sulfonates containing from about 1 to 3 carbon atoms in the alkyl group and from about 8 to 20 carbon atoms in the alkane moiety.

The alkane chains of the foregoing non-soap anionic surfactants can be derived from natural sources such as coconut oil or tallow, or can be made synthetically as for example using the Ziegler or Oxo processes. Water solubility can be achieved by using alkali metal, ammonium or alkanolammonium cations; sodium is preferred. Magnesium and calcium are preferred cations under circumstances described by Belgian Pat. No. 843,636 invented by Jones et al, issued Dec. 30, 1976. Mixtures of anionic surfactants are contemplated by this invention; a preferred mixture contains alkyl benzene sulfonate having 11 to 13 carbon atoms in the alkyl group or paraffin sulfonate having 14 to 18 carbon atoms and either an alkyl sulfate having 8 to 18, preferably 12 to 18, carbon atoms in the alkyl group, or an alkyl polyethoxy alcohol sulfate having 10 to 16 carbon atoms in the alkyl group and an average degree of ethoxylation of 1 to 6.

Suitable detergent builder salts useful herein can be of the polyvalent inorganic and polyvalent organic types, or mixtures thereof. Non-limiting examples of suitable water-soluble, inorganic alkaline detergent builder salts include the alkali metal carbonates, borates, phosphates, polyphosphates, tripolyphosphates and bicarbonate.

Examples of suitable organic alkaline detergency builder salts are:

(1) water-soluble amino polyacetates, e.g. sodium and potassium ethylenediaminetetraacetates, nitrilotriacetates, and N-(2-hydroxyethyl)nitrilodiacetates;
(2) water-soluble salts of phytic acid, e.g. sodium and potassium phytates;
(3) water-soluble polyphosphonates, including, sodium, potassium and lithium salts of ethane-1-hydroxy-1,1-diphosphonic acid; sodium, potassium and lithium salts of methylenediphosphonic acid and the like.

A further class of builder salts is the insoluble alumino silicate type which functions by cation exchange to remove polyvalent mineral hardness and heavy metal ions from solution. A preferred builder of this type has the formulation $Na_z(AlO_2)_z(SiO_2)_y.xH_2O$ wherein z and y are integers of at least 6, the molar ratio of z to y is in the range from 1.0 to about 0.5 and x is an integer from about 15 to about 264. Compositions incorporating builder salts of this type form the subject of British patent specification No. 1,429,143, published March 24, 1976, German patent application OLS No. 2433,485, published Feb. 6, 1975, and OLS No. 2,525,778 published Jan. 2, 1976, the disclosures of which are incorporated herein by reference.

Other optional ingredients include suds modifiers particularly those of suds suppressing type, exemplified by silicones, and silica-silicone mixtures.

U.S. Pat. No. 3,933,672 issued Jan. 20, 1976, to Bartollota et al., incorporated herein by reference, discloses a silicone suds controlling agent. The silicone material can be represented by alkylated polysiloxane materials such as silica aerogels and xerogels and hydrophobic silicas of various types. The silicone material can be described as siloxane having the formula:

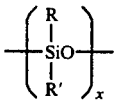

wherein x is from about 20 to about 2,000 and R and R' are each alkyl or aryl groups, especially methyl, ethyl, propyl, butyl and phenyl. The polydimethylsiloxanes (R and R' are methyl) having a molecular weight within the range of from about 200 to about 2,000,000, and higher, are all useful as suds controlling agents. Additional suitable silicone materials wherein the side chain groups R and R' are alkyl, aryl, or mixed alkyl or aryl hydrocarbyl groups exhibit useful suds controlling properties. Examples of the like ingredients include diethyl-, dipropyl-, dibutyl-, methyl-, ethyl-, phenylmethylpolysiloxanes and the like. Additional useful silicone suds controlling agents can be represented by a mixture of an alkylated siloxane, as referred to hereinbefore, and solid silica. Such mixtures are prepared by affixing the silicone to the surface of the solid silica. A preferred silicone suds controlling agent is represented by a hydrophobic silanated (most preferably trimethylsilanated) silica having a particle size in the range from about 10 millimicrons to 20 millimicrons and a specific surface area above about 50 $m^2/g$. intimately admixed with dimethyl silicone fluid having a molecular weight in the range from about 500 to about 200,000 at a weight ratio of silicone to silanated silica of from about 1:1 to about 1:2. The silicone suds suppressing agent is advantageously releasably incorporated in a water-soluble or water-dispersible, substantially non-surface-active detergent-impermeable carrier.

Particularly useful suds suppressors are the self-emulsifying silicone suds suppressors, described in German patent application DTOS No. 2,646,126 published April 28, 1977 and incorporated herein by reference. An example of such a compound is DC-544, commercially available from Dow Corning, which is a siloxane/-glycol copolymer.

Suds modifiers as described above are used at levels of up to approximately 5%, preferably from 0.1 to 2% by weight of the nonionic surfactant. They can be incorporated into the particulates of the present invention or can be formed into separate particulates that can then be mixed with the particulates of the invention. The incorporation of the suds modifiers as separate particulates also permits the inclusion therein of other suds controlling materials such as $C_{20}$–$C_{24}$ fatty acids, microcrystalline waxes and high MWt copolymers of ethylene oxide and propylene oxide which would otherwise adversely affect the dispersibility of the matrix. Techniques for forming such suds modifying particulates are disclosed in the previously mentioned Bartolotta et al U.S. Pat. No. 3,933,672.

Preferred soil suspending and anti-redeposition agents include methyl cellulose derivatives and the copolymers of maleic anhydride and either methyl vinyl ether or ethylene.

Another class of stain removal additives useful in the present invention are enzymes.

Preferred enzymatic materials include the commercially available amylases, and neutral and alkaline proteases conventionally incorporated into detergent compositions. Suitable enzymes are discussed in U.S. Pat. Nos. 3,519,570 and 3,533,139.

In the Examples which follow, the abbreviations used have the following designation:

- LAS: Linear $C_{12}$ alkyl benzene sulphonate
- $AE_3S$: Sodium linear $C_{12-14}$ alcohol sulfate including 3 ethylene oxide moieties
- $CnAE_n$: Coconut alcohol ethoxylated with n moles of ethylene oxide per mole of alcohol
- MTMAC: Myristyl trimethyl ammonium chloride
- CDMAC: Coconut alkyl dihydroxyethyl methyl ammonium chloride
- Dobanol 45-E-7: A $C_{14-15}$ oxo-alcohol with 7 moles of ethylene oxide, marketed by Shell
- Dobanol 45-E-4: A $C_{14-15}$ oxo alcohol with 4 moles of ethylene oxide, marketed by Shell
- Dobanol 91-E-3: A $C_{9-11}$ oxo alcohol with 4 moles of ethylene oxide, marketed by Shell
- TAED: Tetraacetyl ethylene diamine
- AOBS: Sodium p-acetoxy benzene sulphonate
- TAHD: Tetraacetyl hexamethylene diamine
- Imvite: Sodium montmorillonite marketed by IMV, Nevada U.S.A.
- M100: Calcined kaolin marketed by English China Clays
- Zeolite A: Prepared by alkali treatment of metakaolin
- Silicate: Sodium silicate having an $SiO_2$:$Na_2O$ ratio of 1.6.
- Wax: Microcrystalline wax-Witcodur 272 M.pt 87° C.
- Silicone Prill: Comprising 0.14 parts by weight of an 85:15 by weight mixture of silanated silica and silicone, granulated with 1.3 parts of sodium tripolyphosphate, and 0.56 parts of tallow alcohol condensed with 25 molar proportions of ethylene oxide
- Gantrez AN119: Trade Name for maleic anhydride/-vinyl methyl ether copolymer, believed to to have an average molecular weight of about 240,000, marketed by GAF. This was prehydrolysed with NaOH before addition.
- Brightener: Disodium 4,4'-bis(2-morpholino-4-anilino-s-triazin-6-ylamino)stilbene-2:2'-disulphonate.
- Dequest 2060: Trade Name for diethylene triamine penta(methylene phosphonic acid), marketed by Monsanto
- Dequest 2041: Trade Name for ethylenediamine tetra (methylene phosphonic acid), marketed by Monsanto.

The present invention is illustrated by the following non-limiting examples:

EXAMPLES I–VI

The following granular detergent compositions are prepared by spraying a mixture of the liquid or liquifiable ingredients (nonionic, cationic surfactants, silicone oil, etc.) onto a mixture of the solid ingredients (silicate, bleach activator, phosphonic acids etc.) in a pan granulator

| | EXAMPLES | | | | | |
|---|---|---|---|---|---|---|
| | I | II | III | IV | V | VI |
| Dobanol 45-E-7 | — | 12 | 22 | 10 | 15 | — |
| Dobanol 45-E-4 | — | 8 | — | — | — | 5 |
| Dobanol 91-E-3 | 10 | — | — | — | 5 | — |
| $CnAE_9$ | 12 | — | — | — | — | 15 |

-continued

| | EXAMPLES | | | | | |
|---|---|---|---|---|---|---|
| | I | II | III | IV | V | VI |
| MTMAC | — | — | 9 | 5 | 5 | — |
| CDMAC | — | 5 | — | — | — | — |
| LAS | — | — | — | 5 | 5 | — |
| Silicone oil | 2 | — | 1 | — | — | 1 |
| Imvite (13% moisture) | — | — | 43 | — | 38 | — |
| M100 (0.6% moisture) | 44 | 49 | — | — | — | 19 |
| Zeolite A | — | — | — | 53 | — | 30 |
| TAED (Particle size 150 to 250μ) | — | — | 21.6 | 22 | — | — |
| AOBS | — | 18.3 | — | — | 22 | 20 |
| TAHD | 29 | — | — | — | — | — |
| Dequest 2041 | — | — | 2 | 5 | — | — |
| Dequest 2060 | — | 4 | — | — | 5 | — |
| Gantrez AN119 | 3 | — | 1 | — | 5 | — |
| Brightener | — | 0.7 | 0.4 | — | — | — |

The above products are non-bleeding, free-flowing granular compositions having high granule strength, low dust and low moisture pick-up on storage in conventional wax-laminated cations at 32° C. and 80% relative humidity; they have excellent activator storage stability and rapid dispersibility in aqueous detergent media, and when added to an aqueous perborate-containing detergent medium, they provide rapid generation of peroxy acetic acid (i.e. at least about 50%, and in some instances at least 80% of the theoretical yield within about 8 minutes of addition at 25° C. to a standard detergent solution containing 16,000 ppm tetrasodium pyrophosphate, 1800 ppm sodium perborate tetrahydrate and 36 ppm sodium ethylene diamine tetraacetate), with only a slow loss of peroxy acetic acid activity thereafter.

EXAMPLES VII TO XI

The following detergent compositions are prepared by dry-mixing bleach activator containing particulate mixtures (I), made by the process of Examples I to VI, with auxiliary granular mixtures (II) prepared by spray drying and, where appropriate, with sodium perborate tetrahydrate, silicone prill and enzyme. The spray-dried granular mixtures are prepared from an aqueous slurry containing the builder, surfactant components etc. by spraying in a countercurrent of hot air at an inlet temperature of 300°-360° C.

All exemplified particulate mixtures herein have a pH when thoroughly dispersed in water at 2% concentration of less than 7.

| | EXAMPLES | | | | |
|---|---|---|---|---|---|
| | VII | VIII | IX | X | XI |
| Granules I | | | | | |
| Dobanol 45-E-7 | 20 | 15 | 10 | 23 | 20 |
| MTMAC | 11 | 15 | — | — | — |
| Silicone oil | 0.5 | — | — | 1.5 | — |
| Imvite | 45 | — | — | — | 48 |
| M100 | — | 50 | — | — | — |
| Zeolite | — | — | 55 | — | — |
| Refined sedimentary kaolin | — | — | — | 43 | — |
| TAED | 22 | — | 25 | 25 | 32 |
| AOBS | — | 20 | — | — | — |
| Gantrez AN119 | 1 | — | — | — | — |
| Dequest 2041 | — | — | 10 | 7 | — |
| Brightener | 0.5 | — | — | 0.5 | — |
| Granules II | | | | | |
| LAS | 15 | 2 | — | 1 | 10 |
| $AE_3S$ | — | — | 20 | — | — |
| Dobanol 45-E-7 | — | — | — | — | 5 |

-continued

| | EXAMPLES | | | | |
|---|---|---|---|---|---|
| | VII | VIII | IX | X | XI |
| Dobanol 45-E-4 | — | — | — | 5 | — |
| MTMAC | — | — | — | — | 5 |
| Sodium tripolyphosphate | 33 | 40 | 10 | 60 | 45 |
| Silicate | 10 | — | — | — | 10 |
| Dequest 2041 | 3 | 5 | — | — | 0.5 |
| Wax | — | — | 1 | — | 2 |
| Sodium sulphate & water | 39 | 53 | 69 | 34 | 22.5 |
| Final Composition | | | | | |
| Granules I | 39 | 50 | 15 | 24 | 6 |
| Granules II | 40 | 30 | 60 | 70 | 68 |
| Sodium perborate tetrahydrate | 20 | 18 | 25 | 5 | 25 |
| Silicone prill | — | 2 | — | — | 1 |
| Alcalase enzyme | 1 | — | — | 1 | — |

The above products are free-flowing granular compositions having excellent detergency performance on both greasy and bleachable stains and displaying excellent physical and chemical storage characteristics.

What is claimed is:

1. A granular laundry composition containing from about 0.5% to 100% by weight of a particulate mixture having a pH in 2% aqueous dispersion of from about 2.0 to about 9.0 and comprising:

(a) finely-divided, water-insoluble natural or synthetic silica or silicate having an average primary particle size of less than about 10μ, said natural or synthetic silica or silicate being selected from the group consisting of smectite-type clays, kaolinite-type clays, aluminosilicates of the zeolite type, silica aerogels, amophous aluminosilicates, precipitated silica, silica xerogels, fumed silica, magnesium silicates of the formula $nMgO:SiO_2$ wherein n is from about 0.25 to 4, and mixtures thereof, (b) finely-divided organic peroxy acid bleach precursor having an average particle size of less than about 500μ in a weight ratio of (a) to (b) of from about 20:1 to about 1:10, and (c) alkoxylated nonionic surfactant in a weight ratio of (a) to (c) from about 20:1 to about 1:3, said alkoxylated nonionic surfactant being selected from the group consisting of the condensation product of primary or secondary aliphatic alcohols having from 8 to 24 carbon atoms, in either straight chain or branched chain configuration, with from 1 to about 18 moles of alkylene oxide per mole of aliphatic alcohol, and mixtures thereof.

2. The composition of claim 1 wherein the water-insoluble silica or silicate has an average primary particle size of less than about 4μ and a pore volume of at least about 0.1 cc/g and wherein the particulate mixture has a moisture pick-up after 72 hours at 32° C. and 80% relative humidity of no more than about 3.5%.

3. The composition of claim 1 wherein the particulate mixture comprises from about 15% to about 60% thereof of the water-insoluble silica or silicate, from about 5% to about 80% of the organic peroxyacid bleach precursor, from about 5% to about 40% of the alkoxylated nonionic surfactant and is essentially free of inorganic per-compounds which yield hydrogen peroxide in water.

4. The composition of claim 1 wherein the water-insoluble silicate is a smectite-type clay selected from the group consisting of alkali and alkaline earth metal montmorillonites, saponites and hectorites having a moisture content in the range from about 8% to about 20% or a kaolinite-type clay selected from kaolin and metakaolin having a moisture content in the range from about 0.1 to 18%.

5. The composition of claim 1 wherein the water-insoluble silicate is an aluminosilicate of the general formula:

$$Na_z(AlO_2)_z(SiO_2)_y xH_2O$$

wherein z and y are integers of at least about 6, the molar ratio of z to y is in the range from about 1.0 to about 0.5 and x is a number such that the moisture content of the aluminosilicate is from about 10% to about 28% by weight.

6. The composition of claim 1, 4 or 5 wherein the alkoxylated nonionic surfactant is an ethoxylated primary or secondary $C_{9-15}$ alcohol having an average degree of ethoxylation from about 3 to about 9 inclusive and an average HLB in the range from about 9.5 to about 13.5.

7. The composition of claim 1, 4 or 5 which additionally comprises a polyphosphonic acid or salt thereof having the general formula:

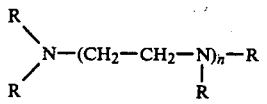

in which n is an integral number from 1 to 14 and each R is individually hydrogen or $CH_2PO_3H_2$ or a water-soluble salt thereof, wherein the weight ratio of the water-insoluble silica or silicate to the polyphosphonic acid or salt thereof is in the ratio of from about 100:1 to about 1:1.

8. The composition of claim 1 wherein the particulate mixture additionally comprises from about 5 to about 40% thereof of water-soluble cationic surfactant having the general formula:

$$R^1_m R^2_{4-m} N^+ Z$$

wherein $R^1$ is selected from $C_{8-20}$ alkyl, alkenyl and alkaryl groups; $R^2$ is selected from $C_{1-4}$ alkyl, and benzyl groups; Z is an anion in number to give electrical neutrality; and m is 1, 2 or 3; provided that when m is 2, $R^1$ has less than 15 carbon atoms and when m is 3, $R^1$ has less than 9 carbon atoms.

9. The composition of claim 1 wherein the finely-divided, water-insoluble natural or synthetic silica or silicate has a moisture content of from about 0.1% to about 30%.

10. The composition of claim 9 wherein the organic peroxy acid bleach precursor is selected from those which produce a peroxycarboxylic acid on reaction with an inorganic persalt, and mixtures thereof.

11. The composition of claim 10 wherein said precursor is selected from the group consisting of methyl o-acetoxy benzoate, sodium-p-acetoxy benzene sulfonate, Bisphenol A diacetate, tetra acetyl ethylene diamine, tetra acetyl hexamethylene diamine and tetra-acetyl methylene diamine.

* * * * *